US005469199A

United States Patent [19]

Allen et al.

[11] Patent Number: 5,469,199

[45] **Date of Patent: * Nov. 21, 1995**

[54] WIDE INKJET PRINTHEAD

[75] Inventors: Ross R. Allen, Belmont; Si-Ty Lam, Pleasanton, both of Calif.; Paul H. McClelland, Monmouth, Oreg.; Eric G. Hanson, Burlingame, Cal.

[73] Assignee: Hewlett-Packard Company, Palo Alto, Calif.

[ * ] Notice: The portion of the term of this patent subsequent to Mar. 1, 2011, has been disclaimed.

[21] Appl. No.: 864,890

[22] Filed: Apr. 2, 1992

Related U.S. Application Data

[63] Continuation-in-part of Ser. No. 849,650, Mar. 9, 1992, Pat. No. 5,305,018, which is a continuation of Ser. No. 568,000, Aug. 16, 1990.

[51] Int. Cl.[6] ..... B41J 2/05; B41J 2/145

[52] U.S. Cl. ..... 347/42; 347/56

[58] Field of Search ..... 346/1.1, 140 R; 29/890.1; 205/75; 347/47, 56, 87, 42

[56] References Cited

U.S. PATENT DOCUMENTS

| | | | |
|---|---|---|---|
| 4,312,009 | 1/1982 | Lange | 346/140 R |
| 4,450,455 | 5/1984 | Sugitani et al. | 346/140 R |
| 4,490,728 | 12/1984 | Vaught et al. | 346/1.1 |
| 4,500,326 | 10/1985 | Allen et al. | 346/140 R |
| 4,500,895 | 2/1985 | Buck et al. | 346/140 R |
| 4,502,060 | 2/1985 | Rankin et al. | 346/140 R |
| 4,558,333 | 12/1985 | Sugitani et al. | 346/140 R |
| 4,568,953 | 2/1986 | Aoki et al. | 346/140 R |
| 4,580,149 | 4/1986 | Domoto et al. | 346/140 |

(List continued on next page.)

FOREIGN PATENT DOCUMENTS

| | | | |
|---|---|---|---|
| 0309146A2 | 3/1989 | European Pat. Off. . | |
| 0309146 | 3/1989 | European Pat. Off. . | |
| 0367541A2 | 5/1990 | European Pat. Off. . | |
| 0440263 | 8/1991 | European Pat. Off. . | |
| 0454152 | 10/1991 | European Pat. Off. . | |
| 0471157 | 2/1992 | European Pat. Off. | 346/140 R |
| 62-170350 | 7/1987 | Japan | B41J 3/04 |
| 3277554 | 12/1991 | Japan . | |

OTHER PUBLICATIONS

J. W. Green, "Manufacturing Method For Ink Jet Nozzles," IBM Technical Disclosure Bulletin, vol. 24, No. 5, Oct. 1981, pp. 2267–2268.

Nielsen, Niels J., "History of Thinkjet Printhead Development," Hewlett–Packard Journal, May 1985, pp. 4–7.

Gary L. Seiwell et al., "The ThinkJet Orifice Plate: A Part With Many Functions," May 1985, Hewlett Packard Journal, pp. 33–37.

J. I. Crowley et al., "Nozzles for Ink Jet Printers," IBM Technical Disclosure Bulletin, vol. 25, No. 8, Jan. 1983.

J. T. C. Yeh, "Laser Ablation of Polymers," J. Vac. Sci. Tech. May/Jun. 1986, pp. 653–658.

Thomas A. Znotins et al., "Excimer Lasers: An Emerging Technology in Materials Processing," Laser Focus Electro Optics, May 1987, pp. 54–70.

V. Srinivasan, et al., "Excimer Laser Etching of Polymers," Department of Chemical Engineering, Clarkson University, Potsdam, N.Y., received Dec. 30, 1985; accepted for publication, Feb. 19, 1986.

W. Childers, et al. "An Ink Jet Print Head Having Two Cured Photoimaged Barrier Layers," application Ser. No. 07/679, 378 filed Apr. 2, 1991, 29 pages.

(List continued on next page.)

*Primary Examiner*—Benjamin R. Fuller
*Assistant Examiner*—Alrick Bobb

[57] ABSTRACT

A novel, wide inkjet printhead and method of forming said inkjet printhead is disclosed, wherein a pattern of orifices are formed, using a step-and-repeat process, in a flexible tape using laser ablation or other suitable etching devices. The location of the orifices corresponds to where ink will be ejected from the inkjet printhead. The pattern of orifices may extend to any length without difficulty in aligning the orifices, since the tape may be continuous along the entire length of the printhead.

22 Claims, 9 Drawing Sheets

U.S. PATENT DOCUMENTS

| | | | |
|---|---|---|---|
| 4,587,534 | 5/1986 | Saito et al. | 346/140 R |
| 4,611,219 | 9/1986 | Sugitani et al. | 346/140 R |
| 4,683,481 | 7/1987 | Johnson | 346/140 R |
| 4,695,854 | 9/1987 | Cruz-Uribe | 346/140 R |
| 4,712,172 | 12/1987 | Kiyohara et al. | 346/1.1 |
| 4,734,717 | 3/1988 | Rayfield | 346/140 R |
| 4,746,935 | 5/1988 | Allen | 346/140 R |
| 4,773,971 | 9/1988 | Lam et al. | 204/11 |
| 4,780,177 | 10/1988 | Wojnarowski et al. | 156/643 |
| 4,842,677 | 6/1989 | Wojnarowski et al. | 156/643 |
| 4,847,630 | 7/1989 | Bhaskar et al. | 346/1.1 |
| 4,914,736 | 4/1990 | Matsuda | 346/140 R |
| 4,915,981 | 4/1990 | Traskos et al. | 156/643 X |
| 4,926,197 | 5/1990 | Childers et al. | 346/140 R |
| 4,942,408 | 7/1990 | Braun | 346/140 R |
| 4,999,650 | 3/1991 | Braun | 346/140 R |
| 5,016,023 | 5/1991 | Chan et al. | 346/1.1 |
| 5,016,024 | 5/1991 | Lam et al. | 346/1.1 |
| 5,149,419 | 9/1992 | Sexton et al. | 205/75 |
| 5,208,980 | 5/1993 | Hayes | 29/890.1 |
| 5,291,226 | 3/1994 | Schantz et al. | 347/47 X |
| 5,305,018 | 4/1994 | Schantz et al. | 346/1.1 |

OTHER PUBLICATIONS

R. Srinivasan et al., "Self–Developing Photoetching of Poly(ethylene terephthalate) Films by Far–Ultraviolet Excimer Laser Radiation," IBM Thomas J. Watson Research Center, Yorktown Heights, N.Y.; received May 10, 1982; accepted for publication Jul. 2, 1982.

R. Srinivasan, "Kinetics of the Ablative Photodecomposition of Organic Polymers in the Far Ultraviolet," IBM Thomas J. Watson Research Center, Yorktown Heights, N.Y.; received Mar. 21, 1983; accepted for publication Jun. 24, 1983.

FIG. 1a
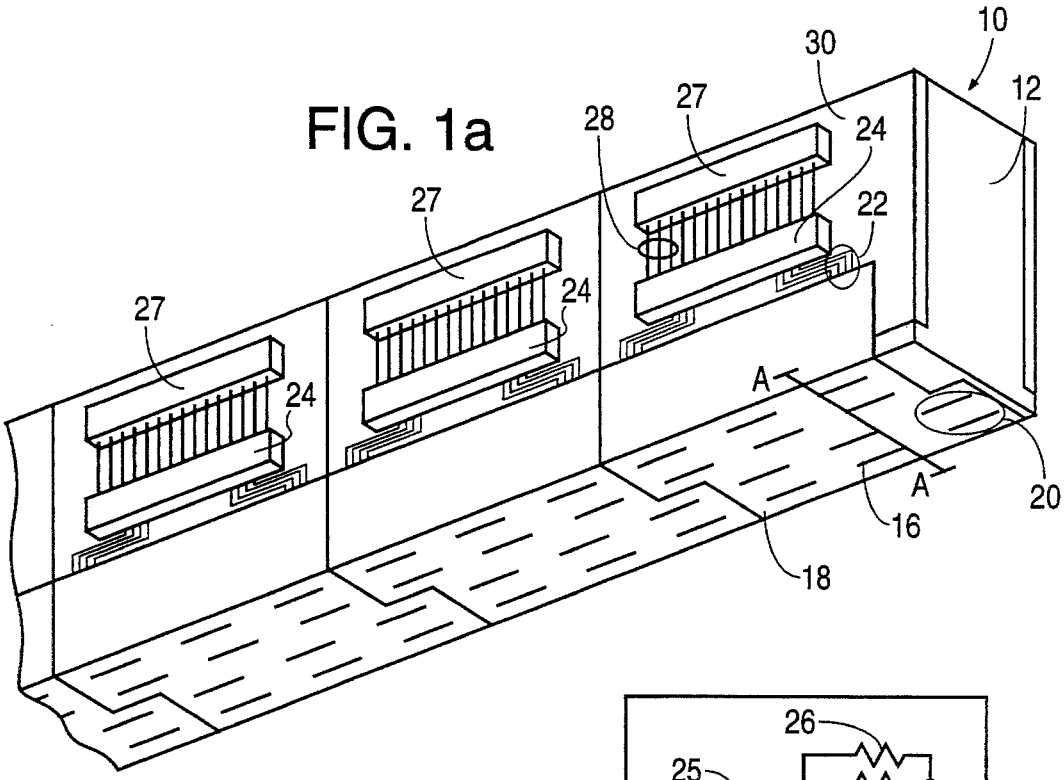
FIG. 1b
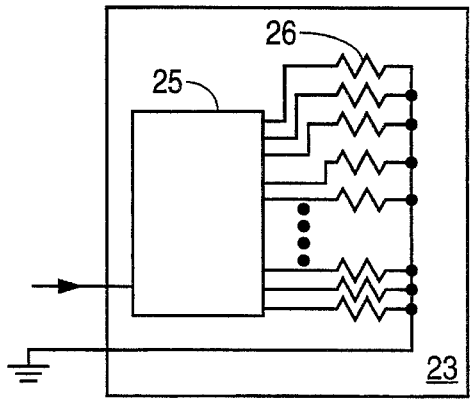
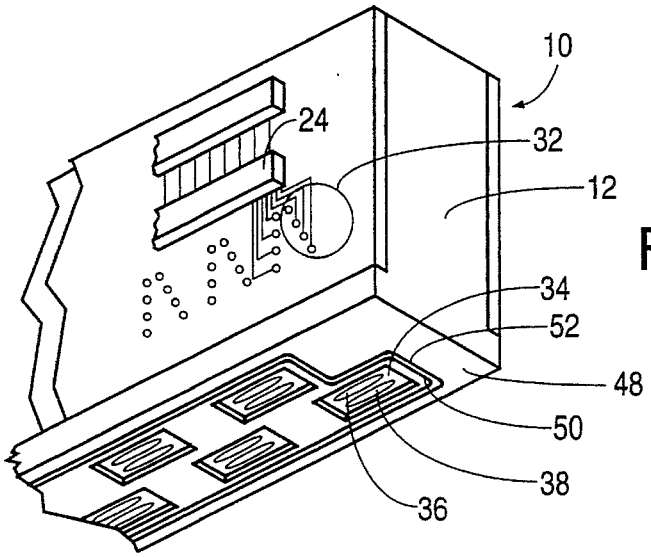
FIG. 2

WIDE INKJET PRINTHEAD

CROSS-REFERENCE TO RELATED APPLICATIONS

This application is a continuation-in-part application of application Ser. No. 07/849,650 (now U.S. Pat. No. 5,305,018), filed on Mar. 9, 1992, which is a continuation of application Ser. No. 07/568,000, filed on Aug. 16, 1990, entitled "Excimer Laser Ablated Components for Inkjet Printhead."

This application relates to the subject matter disclosed in the following U.S. Patent and U.S. Applications:

U.S. Pat. No. 4,926,197 to Childers, entitled "Plastic Substrate for Thermal Ink Jet Printer;"

U.S. application Ser. No. 07/568,000, filed Aug. 16, 1990, entitled "Photo-Ablated Components for Inkjet Printheads;" U.S. Pat. No. 5,305,018;

U.S. application Ser. No. 07/862,668, filed herewith, entitled "Integrated Nozzle Member and TAB Circuit for Inkjet Printhead;"

U.S. application Ser. No. 07/862,669, filed herewith, entitled "Nozzle Member Including Ink Flow Channels;" U.S. Pat. No. 5,291,226;

U.S. application Ser. No. 07/864,889, filed herewith, entitled "Laser Ablated Nozzle Member for Inkjet Printhead;" U.S. Pat. No. 5,305,015;

U.S. application Ser. No. 07/862,086, filed herewith, entitled "Improved Ink Delivery System for an Inkjet Printhead;" U.S. Pat. No. 5278,584;

U.S. application Ser. No. 07/864,930, filed herewith, entitled "Structure and Method for Aligning a Substrate With Respect to Orifices in an Inkjet Printhead;" U.S. Pat. No. 5,297,331;

U.S. application Ser. No. 07/864,896, filed herewith, entitled "Adhesive Seal for an Inkjet Printhead;"

U.S. application Ser. No. 07/862,667, filed herewith, entitled "Efficient Conductor Routing for an Inkjet Printhead;" U.S. Pat. No. 5,300,959;

U.S. application Ser. No. 07/864,822, filed herewith, entitled Improved Inkjet Printhead," U.S. Pat. No. 5,420,627.

The above patent and applications are assigned to the present assignee and are incorporated herein by reference.

FIELD OF THE INVENTION

The present invention generally relates to inkjet printers and, more particularly, to nozzle or nozzle members and other components for the print cartridges used in inkjet printers.

BACKGROUND OF THE INVENTION

Thermal inkjet print cartridges operate by rapidly heating a small volume of ink to cause the ink to vaporize and be ejected through one of a plurality of orifices so as to print a dot of ink on a recording medium, such as a sheet of paper. Typically, the orifices are arranged in one or more linear arrays in a nozzle member. The properly sequenced ejection of ink from each orifice causes characters or other images to be printed upon the recording medium as the printhead is moved relative to the medium. The medium is typically shifted each time the printhead has moved across the medium. The thermal inkjet printer is fast and quiet, as only the ink strikes the recording medium. These printers produce high quality printing and can be made both compact and affordable.

In one prior art design, the inkjet printhead generally includes: (1) ink channels to supply ink from an ink reservoir to each vaporization chamber proximate to an orifice; (2) a metal nozzle member in which the orifices are formed in the required pattern; and (3) a silicon substrate containing a series of thin film resistors, one resistor per vaporization chamber.

To print a single dot of ink, an electrical current from an external power supply is passed through a selected thin film resistor. The resistor is then heated, in turn superheating a thin layer of the adjacent ink within a vaporization chamber, causing explosive vaporization, and, consequently, causing a droplet of ink to be ejected through an associated orifice onto the recording medium.

One prior art print cartridge is disclosed in U.S. Pat. No. 4,500,895 to Buck et al., entitled "Disposable Inkjet Head," issued Feb. 19, 1985 and assigned to the present assignee.

Nozzle members or orifice plates for inkjet printheads often are formed of nickel and are fabricated by lithographic electroforming processes. One example of a suitable lithographic electroforming process is described in U.S. Pat. No. 4,773,971, entitled "Thin Film Mandrel" and issued to Lam et al. on Sep. 27, 1988. In such processes, the orifices in a nozzle member are formed by overplating nickel around dielectric discs.

In a thermal inkjet printer incorporating these types of discrete printheads, the thin film heaters are selectively energized while a mechanism transports the printhead across a recording medium, typically a sheet of paper. The recording medium is incrementally moved perpendicular to the travel path of the printhead so as to enable printing at virtually any location on the recording medium.

To increase the speed of printing per line on a medium and to reduce the mechanical complexity of a printer, it is known to mount separate printheads side by side to form a fixed array of printheads extending across an entire width of a medium. Selected printing elements across the array of discrete printheads are energized simultaneously to print an entire line of dots onto the medium. After the line is printed, the medium is incrementally shifted perpendicular to the array of printheads, and the printing process is repeated.

Drawbacks of this construction of an array of discrete printheads include increased electrical complexity, difficulty in precisely aligning the printheads with one another, and increased cost in providing the plurality of printheads.

As is apparent, with resolutions of inkjet printers becoming greater than 300 dots per inch, alignment of the orifices between discrete inkjet printheads across an array of eight inches or more requires extremely precise positioning to achieve satisfactory spacing between printed dots on a medium. This alignment must be maintained throughout the useful life of the product and under different conditions of duty cycle, temperature, shock, and vibration.

Thus, what is needed is an improved wide printhead structure and a method for fabricating a wide printhead structure, where precise alignment of the orifices across the printhead may be accomplished simply and precisely maintained over the life of the product and over a wide range of operating conditions.

SUMMARY OF THE INVENTION

A novel, wide inkjet printhead and method of forming said wide inkjet printhead is disclosed, wherein an arrangement of orifices, for ejecting ink, is formed in a flexible tape, such as Kapton E™ or Upilex™ tape, using laser ablation. Each orifice is associated with a vaporization chamber and a separately energizable thin-film heater to enable the ejection of ink droplets from the individual orifices of the inkjet printhead. The pattern may extend to any length without difficulty in achieving precise alignment of the orifices with respect to each other, since the tape may be continuous along the entire length of the printhead.

Thus, this method does not suffer from the drawbacks of prior art methods of forming wide inkjet printheads, where discrete printheads or nozzle members are positioned side-by-side in a linear array.

In one embodiment, vaporization chambers associated with each of the orifices are also formed in the tape using laser ablation.

Silicon dies containing resistors associated with each of the various vaporization chambers and orifices are then positioned on the tape opposing the vaporization chambers so as to enable the heat generated by energized resistors to cause a droplet of ink to be ejected through an associated orifice. Since the alignment of each silicon die with respect to the orifices has a lower tolerance than the alignment of the orifices themselves, it is a relatively simple procedure to adequately align each silicon die with respect to its associated array of orifices. The tape itself may be formed so as to contain an optical or physical positioning means for precisely positioning the silicon dies.

In one embodiment, electrodes on a silicon die associated with each of the heater resistors may be individually connected to a separate printhead connector terminal. In other embodiments, to limit the required conductive traces on the printhead, the electrical distribution of signals to the various resistors is accomplished by the use of a decoding circuit or a demultiplexing circuit incorporated on the silicon dies themselves.

BRIEF DESCRIPTION OF THE DRAWINGS

The present invention can be further understood by reference to the following description and attached drawings which illustrate the preferred embodiments.

Other features and advantages will be apparent from the following detailed description of the preferred embodiments, taken in conjunction with the accompanying drawings, which illustrate, by way of example, the principles of the invention.

FIG. 1*a* is a perspective view of a wide inkjet printhead in accordance with one embodiment of the invention;

FIG. 1*b* illustrates a general connection of a decoder or a demultiplexer circuit formed on a silicon die.

FIG. 2 is a perspective view of a portion of the printhead of FIG. 1*a* with the nozzle member and the silicon dies removed;

DESCRIPTION OF THE PREFERRED EMBODIMENTS

Figure 3:
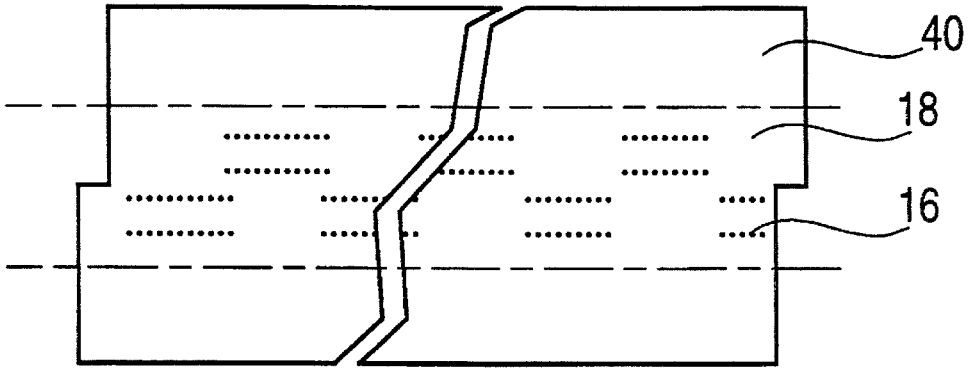
FIG. 3 is a top plan view of a flexible tape illustrating orifice holes after the tape has been cut to form a wide printhead.

FIG. 1*a* illustrates a portion of a wide inkjet printhead in accordance with one embodiment of the invention. The printhead is generally identified by the numeral 10. The printhead 10 includes an ink reservoir 12 containing one or more pieces of foam in which liquid ink of one or more colors is stored. Other means of storing and distributing liquid ink are also feasible and within the scope of this invention. The liquid ink is fed to a vaporization chamber associated with each of the orifice holes 16 formed in a nozzle member 18. The length of the printhead 10 in FIG. 1*a* is preferably the width of a recording medium to be printed upon; however, the printhead 10 may have a nozzle member 18 which contains only a single group of orifices, such as the group designated as numeral 20, or any number of orifice groups. The printhead is scalable for printing across any desired width depending upon the application. For example, the width may extend anywhere between approximately one-sixth inch and twelve inches.

In operation, a heating element within a vaporization chamber behind each of the orifices 16 is selectively energized by a pulse of electricity. The heating element, which may be a thin film resistor, rapidly converts the electrical energy to heat which, in turn, causes ink in contact with the heated resistor to form an ink vapor bubble. As an ink vapor bubble expands within the vaporization chamber, it ejects a droplet of ink from the associated orifice 16 in the nozzle member 18. By appropriate selection of the sequence for energizing the heater resistors in the inkjet printhead 10, ejected ink droplets can be caused to form patterns on a suitable recording medium, such as a sheet of paper. The detailed construction of the vaporization chamber and other features of the printhead 10 in FIG. 1*a* will be explained in detail with respect to subsequent figures.

In one embodiment, each group of orifices, such as the single group designated as 20 in FIG. 1*a*, is associated with a single silicon die containing heater resistors, one heater resistor being associated with a single orifice and vaporization chamber. Since each heater resistor along the entire length of the printhead 10 must be able to be selectively energized, and since each of the silicon dies may contain, for example, 300 separate heater resistors associated with a single group (e.g., group 20) of orifices 16, it may be impractical to provide a separate lead from each of the heater resistors to a contact point on the printhead 10 for contacting individual power supply leads to an external source of energy.

FIG. 1*a* illustrates a more practical structure requiring relatively few conductive traces for routing signals to each of the silicon dies and the heater resistors. In the embodiment shown in FIG. 1*a*, each of the conductive traces 22 provides a serial data path for connection to a single silicon die 23 (FIG. 1*b*) having any number of heater resistors 27. A single ground lead would also be connected to each silicon die. Multiplexer chips 24, mounted on the printhead 10 or on the nozzle member 18, or externally, provide the proper controlling of the serial data signals, generated externally by a printer, and may provide any necessary clocking for each of the silicon dies to properly distribute the serial data stream to the appropriate heater elements located on a silicon die associated with a single group of orifices. A demultiplexer or decode circuit 25 may be located on each of the silicon dies 23 containing the heater resistors 27, such as shown in FIG. 1*b*. Various multiplexing schemes and encoding schemes which can be used would be readily apparent to one of ordinary skill in the art using conventional multiplexing and encoding techniques.

The print signals necessary to be applied to the multiplexer 24 for subsequent application to the various silicon dies are applied to the printhead 10 via connectors 26, which interface the printhead 10 with the inkjet printer circuitry itself. The signals applied to the connectors 26 may be in any form (e.g., serial or parallel) as long as the multiplexer 24 is designed to multiplex or encode such signals so as to apply the appropriate sequenced signals to each of the silicon dies for selective energization of the individual heater elements.

Conductors 28 couple the connectors 27 to the multiplexers 24. The conductors 22 and 28 may comprise conductive traces formed on a printed circuit (PC) board 30 using conventional techniques. The connectors 27 and multiplexers 24 are mounted on the PC board 30 in any conventional manner. Such connectors 27, multiplexers 24, and conductive traces 22 and 28 may also be located on an opposite side of the printhead 10.

The electrical connections from the multiplexers 24 to the silicon dies will be explained later with respect to FIGS. 2 and 4.

FIG. 2 illustrates an end portion of the printhead 10 of FIG. 1*a* with both the nozzle member 18 and the silicon dies removed. Shown in FIG. 2 on the PC board 30 are the exposed conductive traces and contact pads 32 leading from the multiplexer 24. These contact pads 32 are ultimately placed in electrical contact with conductive traces on the back side of the nozzle member 18 which supply signals to the silicon die mounted on the nozzle member 18. The traces on the back of the nozzle member 18 are shown in FIG. 4 as traces 44 being connected to silicon dies 42.

FIG. 2 also illustrates the means used in a preferred embodiment to supply liquid ink from the ink reservoir 12, around the edges of each silicon die, and to the vaporization chambers surrounding each heater resistor on each silicon die. A silicon die is positioned in each of the rectangular wells 34 on the bottom of the printhead 10 in FIG. 2. The slots 36 and 38 within each of rectangular wells 34 communicate with the ink reservoir 12 so that ink may flow through the slots 36 and 38. In one embodiment, the slot 36 may be in fluid communication with one color ink, and the slot 38 may be in fluid communication with another color ink.

In the preferred embodiment, silicon dies are positioned on the back of the nozzle member 18 so as to be aligned with an associated well 34 in FIG. 2. Each of the silicon dies is of such a size that the edges of each silicon die do not completely cover the slots 36 and 38. This enables ink to flow from ink reservoir 12, through the slots 36 and 38, around the edges of a silicon die placed within the well 34, and to each vaporization chamber formed on the back of the nozzle member 18. This is an improvement over the prior art which generally forms a hole through the center of each silicon die by either a laser or a drill in order to supply ink to the opposite surface of the die and to the vaporization chambers arranged around the hole.

FIG. 3 generally shows the front surface of the nozzle member 18 in FIG. 1*a* prior to mounting on the printhead 10. The nozzle member 18 may comprise a flexible polymer tape 40 having orifices 16 formed therein using laser ablation, to be discussed in more detail later.

Figure 4:
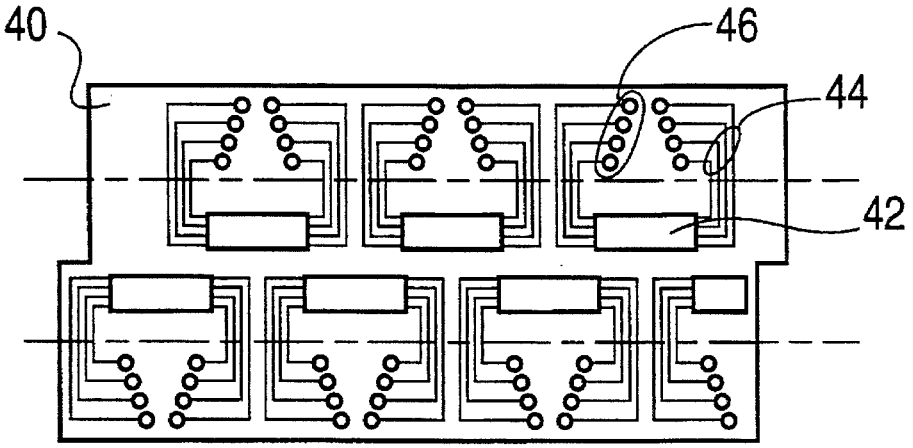
FIG. 4 is a bottom plan view of the flexible tape of FIG. 3 showing the positions of silicon dies and conductive traces for connecting electrodes on the silicon dies to external power sources.

FIG. 4 shows a back side of the tape 40 of FIG. 3 with silicon dies 42 being positioned thereon and being aligned with an associated group of orifices 16 shown in FIG. 3. Also shown in FIG. 4 are conductive traces 44 extending from each of the silicon dies 42 and terminating in contact pads 46.

Each of the silicon dies 42 aligns with and fits into an associated well 34, shown in FIG. 2, so that the back surface of the tape 40, shown in FIG. 4, generally abuts the bottom surface 48 of the printhead 10 in FIG. 2.

In FIGS. 3 and 4, the dashed lines along the tape 40 indicate the fold-line of the tape 40 when mounted to the bottom surface 48 of the printhead 10, wherein the contact pads 46 for the conductive traces 44 in FIG. 4 align with the contact pads 32 formed on the PC board 30 in FIG. 2.

When the tape 40 is mounted to the bottom surface 48 of the printhead 10 in FIG. 2, a seal must be created to firmly secure the tape 40 in place on printhead 10 and to prevent any seepage of ink from between the ink reservoir 12 and the tape 40.

In a preferred embodiment, an adhesive seal is made between the bottom surface 48 of the printhead 10 and the tape 40 generally along the boundary lines 50 and 52, shown in FIG. 2, which enclose all wells 34 and silicon dies 42 when subsequently mounted. Using the preferred embodiment described below, a seal need not be made around each individual silicon die or well 34, but a single seal may be made to encompass all silicon dies. This seal is illustrated in detail in FIGS. 5 and 6. In an alternative embodiment, an adhesive seal is also made between the bottom surface 48 of the printhead and the tape 40 around each of the silicon dies individually to prevent seepage of ink from outside the wells 34.

Figure 5:
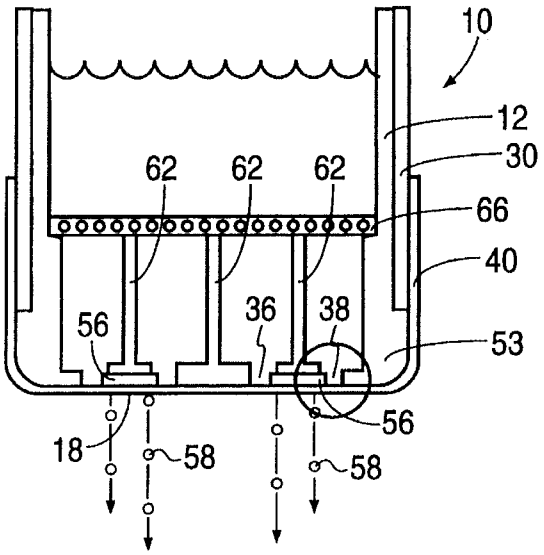
FIG. 5 is a side elevational view in cross-section and partially cut away of the printhead of FIG. 1*a* taken along the line A—A in FIG. 1*a* illustrating how the nozzle member is affixed to the printhead body.

FIG. 5 is a side elevational view in cross-section and partially cut away of the printhead 10 in FIG. 1*a* taken along line A—A. Shown in FIG. 5 is the nozzle member 18 being adhesively secured to a lower wall 53 of the ink reservoir 12 and to the PC board 30. Also shown in FIG. 5 are two silicon dies 56, each associated with a group of orifices. Ink droplets 58 are illustrated as being ejected from orifices associated with the silicon dies 56 upon energization of selected heater resistors formed on the silicon dies 56. Also shown in FIG.

5 are support columns 62, which are provided to add structural integrity to the generally flexible nozzle member 18, to maintain the nozzle member 18 planar along the printhead 10, and to define ink slots 36 and 38 in FIGS. 2 and 5. These columns 62 may also be used as barriers between two or more ink colors to be distributed to different ones of the slots 36 and 38.

Each of the silicon dies 56 is located within an associated well, one well being identified as well 34 in FIG. 2. The back surfaces of the dies 56 may be adhesively secured to the wells 34 if needed for additional nozzle member 18 rigidity.

In FIG. 5, ink flows from the ink reservoir 12, through a filter screen 66, then through the slots 36 and 38 and around the edges of the silicon dies 56. The ink then enters vaporization chambers formed on a back surface of the nozzle member 18, each vaporization chamber being associated with a heater resistor formed on the silicon dies 56. The screen 66 may be a knit of woven stainless steel wires.

Figure 6:
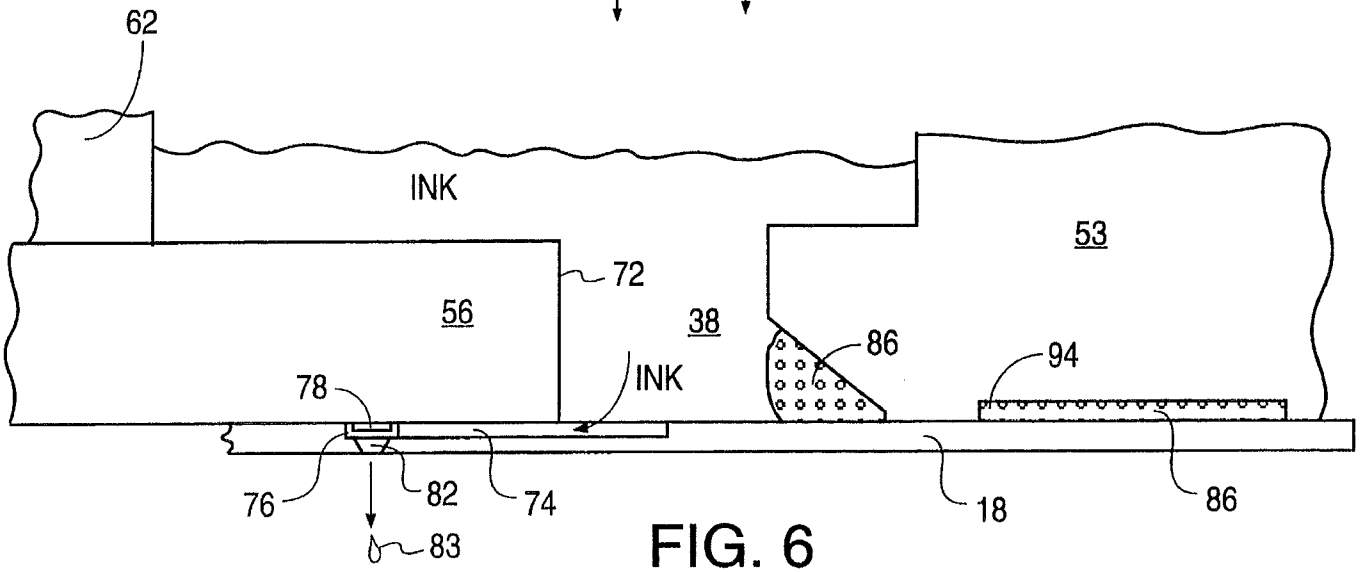
FIG. 6 is an enlarged view of the structure of FIG. 5 enclosed by the circle B—B in FIG. 5.

FIG. 6 is an enlarged view of the circled portion B—B in FIG. 5 illustrating the flow of ink 67 around an edge of the silicon dies 56 and the method of securing the nozzle member 18 to the lower wall 53 of the ink reservoir 12.

In FIG. 6, the lower wall 53 of the ink reservoir 12 is shown substantially abutting a back surface of the nozzle member 18. The wall 53 may be made of plastic or any other suitable material for retaining ink within the printhead 10. A single silicon die 56 is also shown mounted to the nozzle member 18 so that a front surface of the silicon die 56 containing the heater resistors faces the back surface of the nozzle member 18. A back surface of the silicon die 56 is shown exposed to the ink from the ink reservoir 12 and supported by a column 62.

In order for ink to flow around a right edge 72 of the silicon die 56 so as to enter a vaporization chamber, an ink channel 74 is formed in the back surface of the nozzle member 18, which leads to a vaporization chamber 76 so as to bring ink in contact with a heater resistor 78. The ink channel 74 and vaporization chamber 76, as well as the orifice 80, may be formed in the nozzle member 18 using laser ablation. The ablated pattern may be obtained by using one or more masks in a step-and-repeat process.

When the heater resistor 78 is energized, a small portion of liquid ink within the vaporization chamber 76 is vaporized so as to form a bubble, causing the ejection of a droplet 81 of ink through the associated orifice 80 formed in the nozzle member 18. A similar construction allows ink to flow around a left edge of the silicon die 56 to enable ink to be supplied to vaporization chambers on the left side of the silicon die 56.

In a preferred embodiment, a liquid seal and strong adhesion between the nozzle member 18 and the printhead walls 53 are provided by applying an adhesive 82 in the manner shown in FIG. 6. FIG. 6 shows a peripheral edge of the wall 53 adjacent to the nozzle member 18 cut at an angle and then filled with an adhesive 82, such as epoxy. This first seal is generally shown by the inner boundary line 50 in FIG. 2 circumscribing the silicon dies when the nozzle member 18 is mounted as shown in FIG. 6.

A second adhesive seal for providing additional adhesion is formed by cutting a slot 83 in a bottom surface of the wall 53, which is then filled with the adhesive 82. This slot 83 is shown as the outer boundary line 52 in FIG. 2 circumscribing the silicon dies when the nozzle member 18 is mounted as shown in FIG. 6.

Figure 7A:
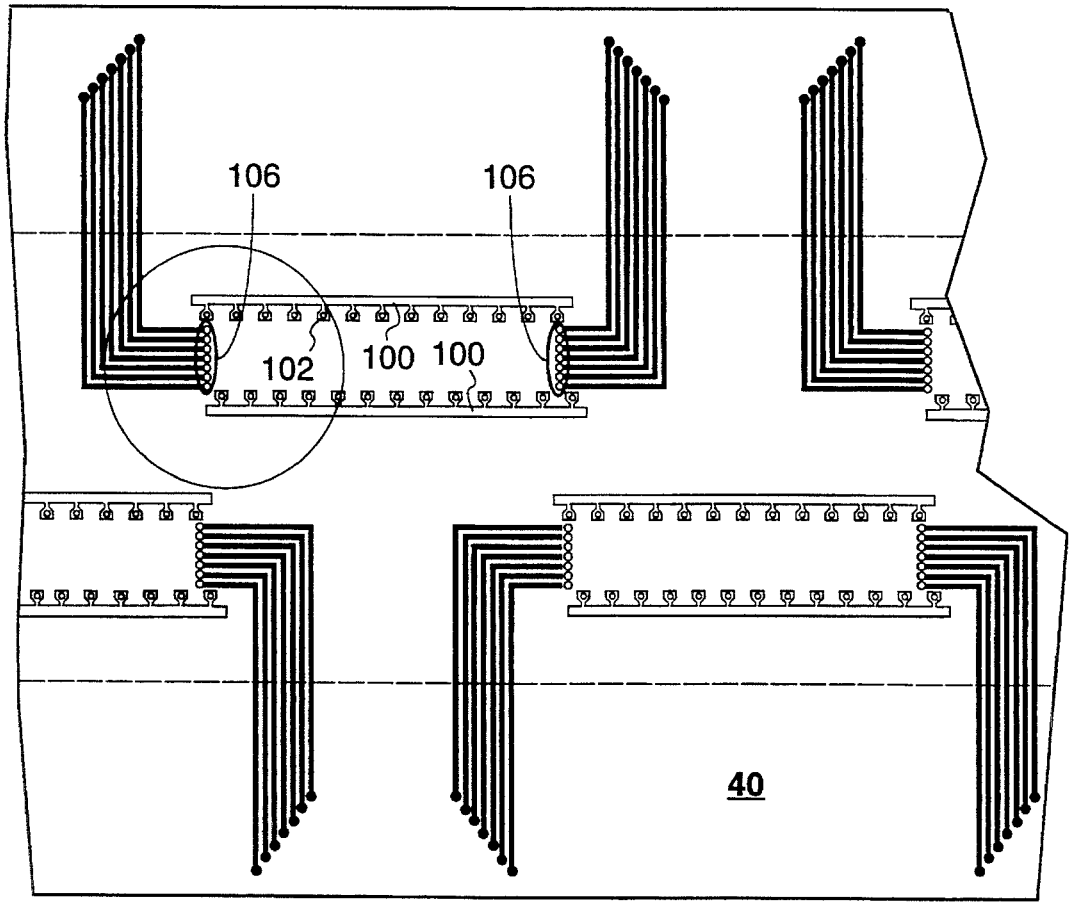
FIG. 7*a* is a bottom plan view, enlarged, of the tape of FIG. 3, prior to silicon dies being mounted onto the tape, showing ink manifolds, ink channels, vaporization chambers, and conductive traces formed in the tape.
Figure 7B:
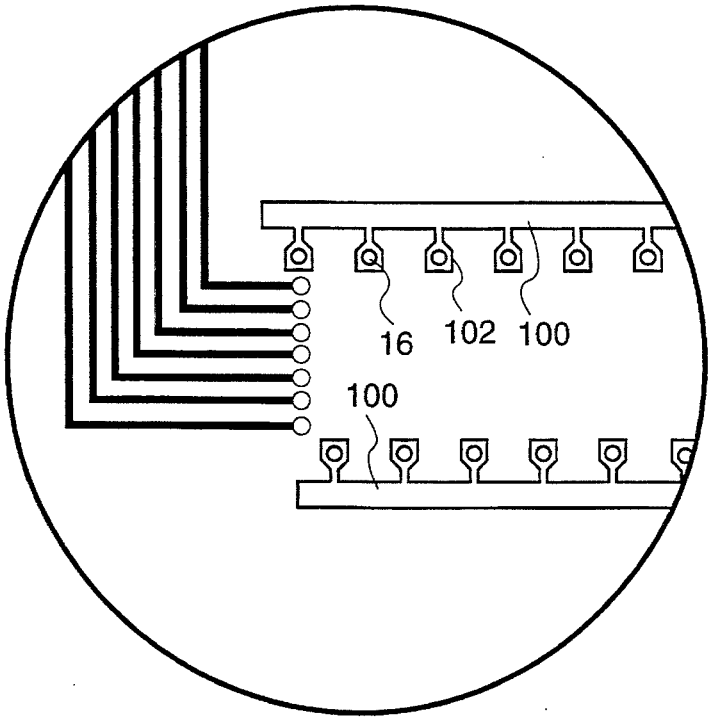
FIG. 7*b* is an enlarged view of the structure of FIG. 7*a* enclosed by the circle C—C.

FIGS. 7*a* and 7*b* illustrate in more detail one embodiment of the back side of the nozzle member 18, which may comprise a flexible tape 40, prior to silicon dies being mounted on the back side of the tape 40. FIG. 7*b* is an enlarged view of the circled portion C—C in FIG. 7*a*. A front surface of the tape 40 in FIGS. 7*a* and 7*b* is shown in FIG. 3. FIGS. 7*a* and 7*b* show the geometries of ink manifolds 84 which are in fluid communication with the slots 36 and 38, shown in FIG. 2, for supplying ink from the ink reservoir 12 to the vaporization chambers 85. Each of the vaporization chambers 85 in FIGS. 7*a* and 7*b* is associated with an orifice 16.

A silicon die, when properly secured to the back surface of the tape 40 in FIG. 7*a* and 7*b*, has heater resistors aligned with each of the vaporization chambers 85 and has edges which expose a portion of the ink manifolds 84 so as to allow the ink manifolds 84 to be in fluid communication with the ink reservoir 12 through the slots 36 and 38 in FIG. 2.

Figure 8:
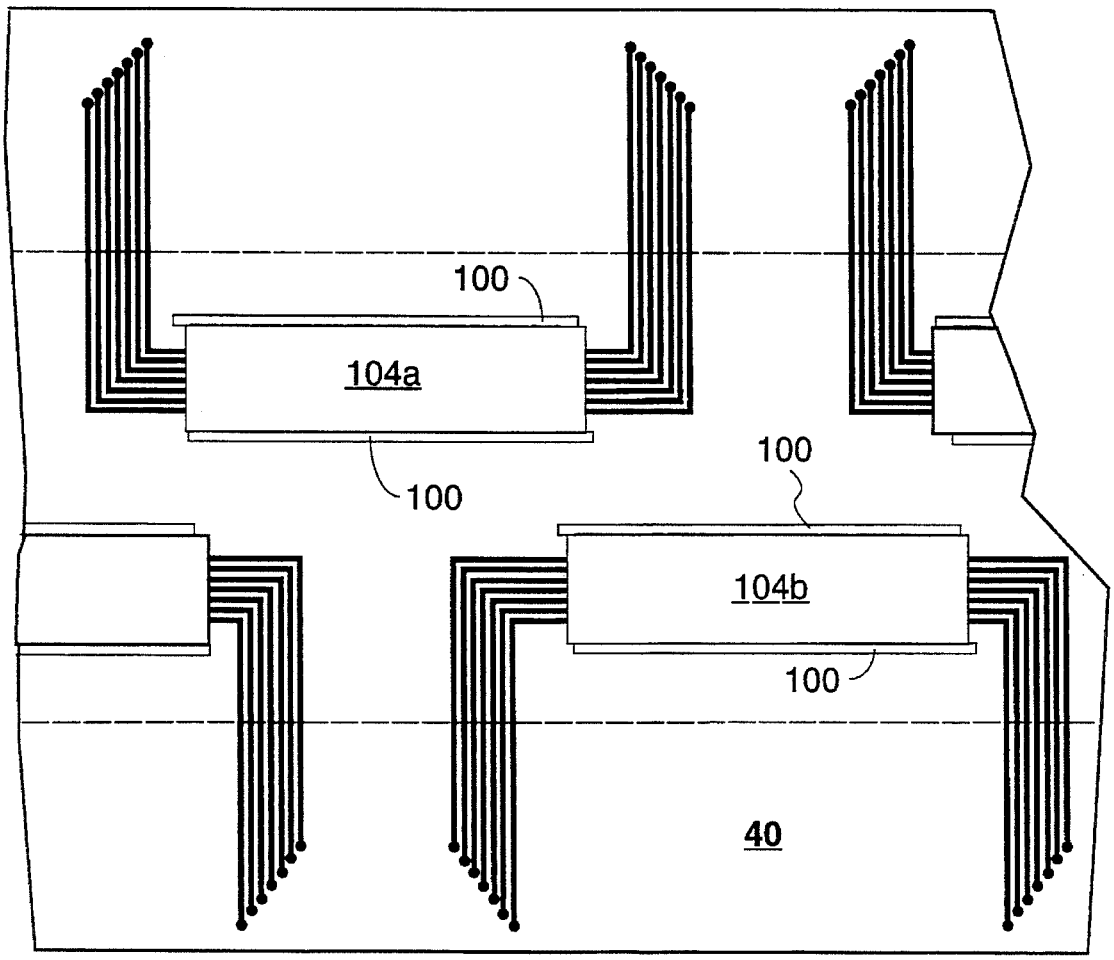
FIG. 8 is a bottom plan view, enlarged, of the tape of FIG. 7*a* after silicon dies have been mounted thereon.

FIG. 8 illustrates the back surface of the tape 40 after silicon dies 86*a* and 86*b* are mounted to the back surface of the tape 40 so as to expose a portion of the ink manifolds 84.

Referring back to FIGS. 7*a* and 7*b*, in one embodiment, the silicon dies have one or more electrodes formed on their edges which correspond to conductive trace contact pads 87 for connecting the conductive traces on the tape 40 with electrodes on the silicon dies. In another embodiment, windows are formed in the tape 40 to expose the ends of the conductive traces, and an automatic inner lead bonder is then used to bond the ends of the traces to the electrodes on a silicon die through the windows. Such a process is described in more detail with respect to FIG. 13. When windows are used, a reliable connection can be made using thermocompression bonding other bonding methods may include conductive epoxy, solder, ultrasonic bonding, or any other conventional means.

The silicon dies may be adhesively secured to the tape 40 using an epoxy or other means.

Figure 9:
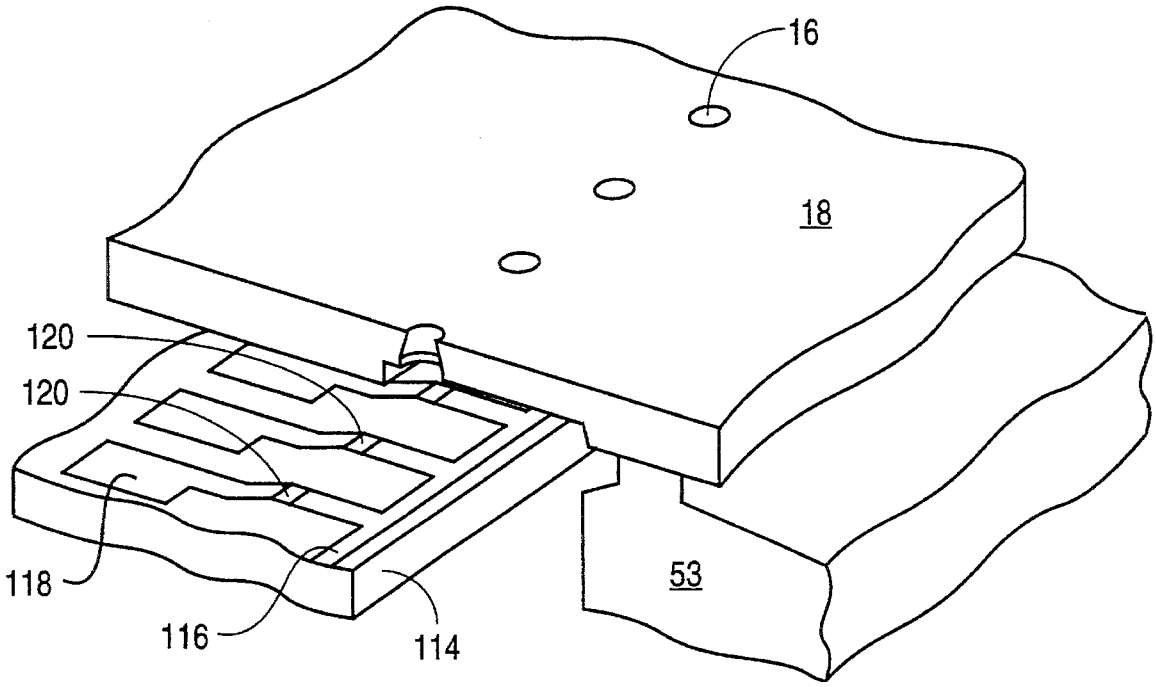
FIG. 9 is a perspective view in cross-section and partially cut away illustrating the alignment of orifice holes with respect to heater resistors.
Figure 10:
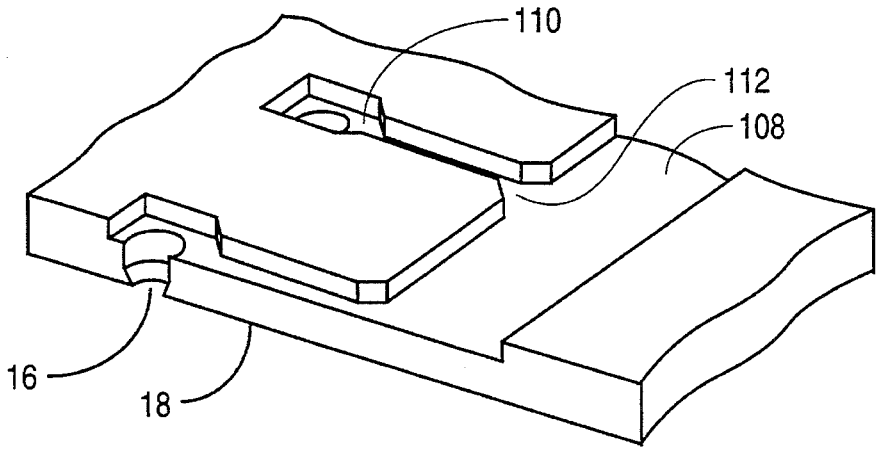
FIG. 10 is a perspective view in cross-section and partially cut away of an underside portion of the nozzle member of FIG. 9 showing the orifice holes, ink channels, and vaporization chambers.

FIG. 9 shows a cross-section of a front surface of the nozzle member 18, partially cut away, which faces the recording medium. The nozzle member 18 includes frustum-shaped orifices 16. The nozzle member 18 is shown affixed to an ink reservoir wall 53, as described with respect to FIG. 6. A portion of the underside of the nozzle member 18 in FIG. 9 is shown in FIG. 10. FIG. 10 shows orifices 16 formed in the nozzle member 18. Also formed in this bottom surface of the nozzle member 18 is an ink manifold 84 which provides fluid communication between the slots 36 and 38 in FIG. 2 and vaporization chambers 85 via ink channels 88. The orifices 16, vaporization chambers 85, ink manifolds 84, and ink channels 88 may be formed using laser ablation or other etching means which entails removing a portion of the nozzle member material in a pattern defined by a mask. In one embodiment, the nozzle member 18 in the various figures may be formed by laser ablating a polymer material, such as Kapton™ or Upilex™, or any of the various other polymers including, but not limited to, teflon, polyimide, polymethylmethacrylate, polyethyleneterephthalate, or mixtures thereof. Laser ablation may be conducted using an Excimer laser. Such a process is described in more detail with respect to FIG. 13.

Figure 11:
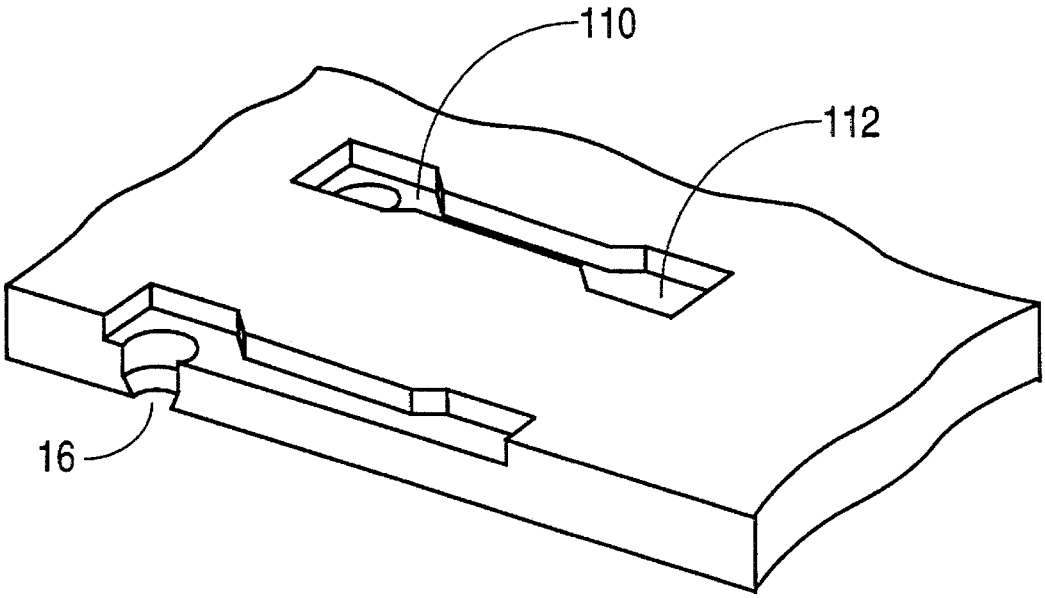
FIG. 11 is a perspective view in cross-section and partially cut away of another embodiment of an underside portion of the nozzle member of FIG. 9.

FIG. 11 illustrates another embodiment of the pattern which may be formed in the underside of the nozzle member 18 in FIG. 9, wherein the ink manifold 84 in FIG. 10 has been deleted, and ink flows directly from the ink reservoir to an inlet portion of the ink channels 88.

The pattern in the nozzle member 18 for the ink channels and vaporization chambers may also be formed in a separate barrier layer which is formed on each silicon substrate, such as described in co-pending application Ser. No. 07/864,822, entitled "Improved Inkjet Printhead," assigned to the present assignee. The barrier layer may be a photoresist layer or other polymer layer and formed on the substrates using conventional photolithographic techniques.

Referring back to FIG. 9, the silicon substrate 90, or any other suitable substrate, is shown having a common conductor 91 for a group of resistors 94, typically connected to a ground potential. The substrate 90 also has electrodes 92 and conductors 93 formed on its surface. The electrodes 92 may be individually connected to a source of pulsed power so as to selectively energize thin film resistors 94 connected between the common conductor 91 and their associated electrodes 92. The common conductor 91, electrodes 92, conductors 93, and thin film resistors 94 may be formed of any suitable material known to those of ordinary skill in the art. The common conductor 91 and electrodes 92 may be connected to appropriate electrodes at edges of the substrate 90, which may contact the pads 87 in FIG. 7*a*. In another embodiment, the back surface of the tape forming the nozzle member 18 may provide conductors to directly contact the individual electrodes 92 and conductor 91 in FIG. 9 rather than providing electrical contact via the pads 87 in FIG. 7*a*.

As previously stated with respect to FIG. 1*b*, each silicon die may include a demultiplexer or decoder to decode incoming signals. This would reduce the number of trace/die interconnects needed, offering improvements in manufacturing and reliability.

As seen in the various figures, most notably FIGS. 1*a*, 3, and 4, any number of orifice groups may be formed on a single strip of tape, wherein each group may be precisely aligned with respect to one another, since such precise alignment can be easily achieved by a step-and-repeat masking and etching or laser ablation procedure. Also in this manner, the vaporization chambers may be precisely aligned with respect to each orifice. The tape containing a plurality of orifice groups may then be formed to any length desired, or cut from a continuous repeating pattern to a desired length.

Figure 12:
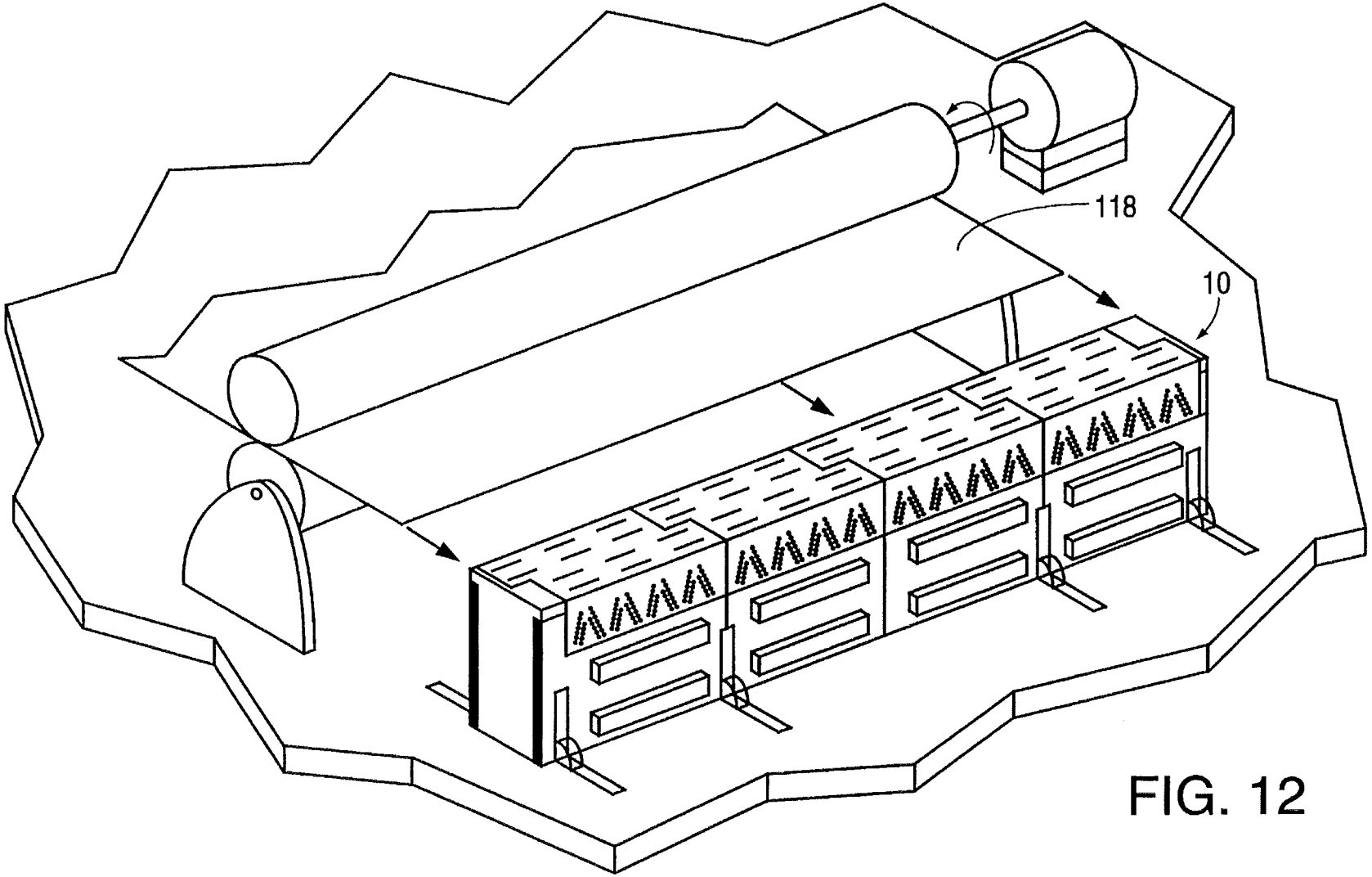
FIG. 12 illustrates one embodiment of a completed printhead with respect to a recording medium when installed in a printer.

FIG. 12 generally illustrates how a wide printhead of the present invention may be used for printing, wherein the printhead 10 is fixed within a printer, and a recording medium 98 is moved with respect to the printhead 10 while the various heaters in the printhead 10 are selectively energized to form characters or images on the medium 98. With a smaller printhead, some transport mechanism would be incorporated in the printer to scan the printhead across the width of the medium 98. Also shown in FIG. 12 is a platen 99, a platen rotating device 100, a pinch roller 101, and a printer body 102.

Figure 13:
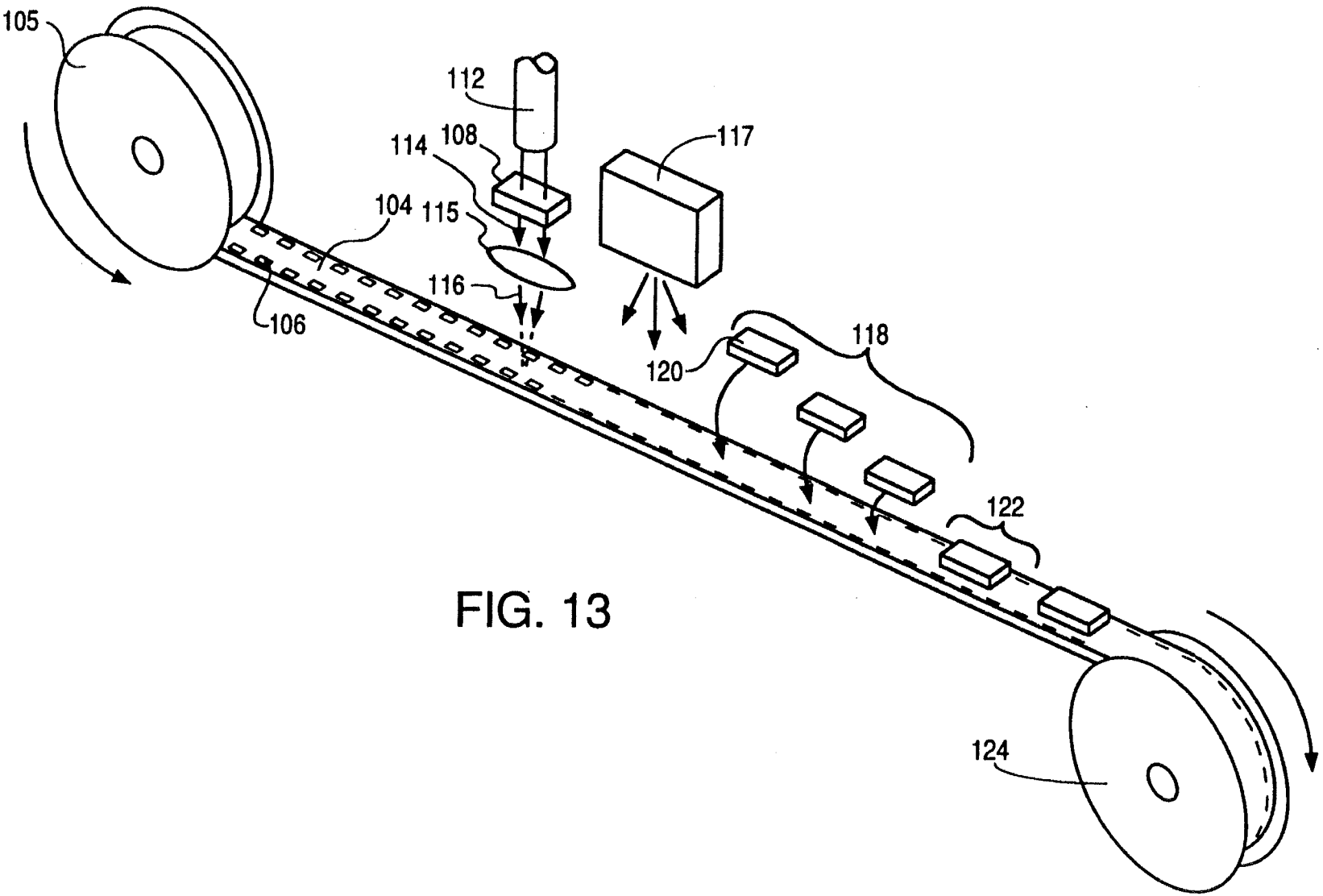
FIG. 13 illustrates one method for forming a nozzle member and positioning silicon dies thereon.

FIG. 13 illustrates one method for forming the preferred embodiments of the nozzle member, including the preferred method for aligning the silicon dies on the nozzle member.

The starting material is a Kapton™ or Upilex™-type polymer tape 104, although the tape 104 can be any suitable polymer film which is acceptable for use in the below-described procedure. Some such films may comprise teflon, polyimide, polymethylmethacrylate, polycarbonate, polyester, polyamide, polyethylene-terephthalate or mixtures thereof.

The tape 104 is typically produced in long strips on a reel 105. Sprocket holes 106 along the sides of the tape 104 are used to accurately and securely transport the tape 104. Alternately, the sprocket holes 106 may be omitted and the tape may be transported with other types of fixtures.

In the preferred embodiment, the tape 104 is already provided with conductive copper traces, such as shown in FIG. 7*a*, formed thereon using conventional metal deposition processes and photolithographic techniques. The particular pattern of conductive traces depends on the manner in which it is desired to distribute electrical signals to the electrodes formed on silicon dies, which are subsequently mounted on the tape 104.

In one embodiment, rectangular windows exposing the ends of the traces in FIG. 7*a* are formed in the tape 104 using conventional photolithographic methods prior to the tape 104 being subjected to the processes shown in FIG. 13.

In the preferred process, the tape 104 is transported to a laser processing chamber and laser-ablated in a pattern defined by one or more masks 108 using laser radiation 110, such as that generated by an Excimer laser 112 of the $F_2$, ArF, KrCl, KrF, or XeCl type. The masked laser radiation is designated by arrows 114.

In a preferred embodiment, such masks 108 define all of the ablated features for an extended area of the tape 104, for example encompassing multiple orifices in the case of an orifice pattern mask 108, and multiple vaporization chambers in the case of a vaporization chamber pattern mask 108. Alternatively, patterns such as the orifice pattern, the vaporization chamber pattern, or other patterns may be placed side by side on a common mask substrate which is substantially larger than the laser beam. Then such patterns may be moved sequentially into the beam. The masking material used in such masks will preferably be highly reflecting at the laser wavelength, consisting of, for example, a multilayer dielectric or a metal such as aluminum.

The orifice pattern defined by the one or more masks 108 may be that generally shown in FIG. 3. Multiple masks 108 may be used to form a stepped orifice taper as shown in FIGS. 9–11.

In an embodiment of a nozzle member where the nozzle member also includes vaporization chambers, one or more masks 108 would be used to form the orifices and another mask 108 and laser energy level (and/or number of laser shots) would be used to define the vaporization chambers, ink channels, and manifolds which are formed through a portion of the thickness of the tape 104.

The laser system for this process generally includes beam delivery optics, alignment optics, a high precision and high speed mask shuttle system, and a processing chamber including a mechanism for handling and positioning the tape 104. In the preferred embodiment, the laser system uses a projection mask configuration wherein a precision lens 115 interposed between the mask 108 and the tape 104 projects the Excimer laser light onto the tape 104 in the image of the pattern defined on the mask 108.

The masked laser radiation exiting from lens 115 is represented by arrows 116.

Such a projection mask configuration is advantageous for high precision orifice dimensions, because the mask is physically remote from the nozzle member. Soot is naturally formed and ejected in the ablation process, traveling distances of about one centimeter from the nozzle member being ablated. If the mask were in contact with the nozzle member, or in proximity to it, soot buildup on the mask would tend to distort ablated features and reduce their dimensional accuracy. In the preferred embodiment, the projection lens is more than two centimeters from the nozzle member being ablated, thereby avoiding the buildup of any soot on it or on the mask.

Ablation is well known to produce features with tapered walls, tapered so that the diameter of an orifice is larger at the surface onto which the laser is incident, and smaller at the exit surface. The taper angle varies significantly with variations in the optical energy density incident on the nozzle member for energy densities less than about two joules per square centimeter. If the energy density were uncontrolled, the orifices produced would vary significantly in taper angle, resulting in substantial variations in exit orifice diameter. Such variations would produce deleterious variations in ejected ink drop volume and velocity, reducing print quality. In the preferred embodiment, the optical energy of the ablating laser beam is precisely monitored and controlled to achieve a consistent taper angle, and thereby a reproducible exit diameter. In addition to the print quality benefits resulting from the constant orifice exit diameter, a taper is beneficial to the operation of the orifices, since the taper acts to increase the discharge speed and provide a more focused ejection of ink, as well as provide other advantages. The taper may be in the range of 5 to 15 degrees relative to the axis of the orifice. The preferred embodiment process described herein allows rapid and precise fabrication without a need to rock the laser beam relative to the nozzle member. It produces accurate exit diameters even though the laser beam is incident on the entrance surface rather than the exit surface of the nozzle member.

After the step of laser-ablation, the polymer tape 104 is stepped, and the process is repeated. This is referred to as a step-and-repeat process. The total processing time required for forming a single pattern on the tape 104 may be on the order of a few seconds. As mentioned above, a single mask pattern may encompass an extended group of ablated features to reduce the processing time per nozzle member.

Laser ablation processes have distinct advantages over other forms of laser drilling for the formation of precision orifices, vaporization chambers, and ink channels. In laser ablation, short pulses of intense ultraviolet light are absorbed in a thin surface layer of material within about 1 micrometer or less of the surface. Preferred pulse energies are greater than about 100 millijoules per square centimeter and pulse durations are shorter than about 1 microsecond. Under these conditions, the intense ultraviolet light photodissociates the chemical bonds in the material. Furthermore, the absorbed ultraviolet energy is concentrated in such a small volume of material that it rapidly heats the dissociated fragments and ejects them away from the surface of the material. Because these processes occur so quickly, there is no time for heat to propagate to the surrounding material. As a result, the surrounding region is not melted or otherwise damaged, and the perimeter of ablated features can replicate the shape of the incident optical beam with precision on the scale of about one micrometer. In addition, laser ablation can also form chambers with substantially flat bottom surfaces which form a plane recessed into the layer, provided the optical energy density is constant across the region being ablated. The depth of such chambers is determined by the number of laser shots, and the power density of each.

Laser-ablation processes also have numerous advantages as compared to conventional lithographic electroforming processes for forming nozzle members for inkjet printheads. For example, laser-ablation processes generally are less expensive and simpler than conventional lithographic electroforming processes. In addition, by using laser-ablations processes, polymer nozzle members can be fabricated in substantially larger sizes (i.e., having greater surface areas) and with nozzle geometries that are not practical with conventional electroforming processes. In particular, unique nozzle shapes can be produced by controlling exposure intensity or making multiple exposures with a laser beam being reoriented between each exposure. Examples of a variety of nozzle shapes are described in copending application Ser. No. 07/658726, entitled "A Process of Photo-Ablating at Least One Stepped Opening Extending Through a Polymer Material, and a Nozzle Plate Having Stepped Openings," assigned to the present assignee and incorporated herein by reference. Also, precise nozzle geometries can be formed without process controls as strict as those required for electroforming processes.

Another advantage of forming nozzle members by laser-ablating a polymer material is that the orifices or nozzles can be easily fabricated with various ratios of nozzle length (L) to nozzle diameter (D). In the preferred embodiment, the L/D ratio exceeds unity. One advantage of extending a nozzle's length relative to its diameter is that orifice-resistor positioning in a vaporization chamber becomes less critical.

In use, laser-ablated polymer nozzle members for inkjet printers have characteristics that are superior to conventional electroformed orifice plates. For example, laser-ablated polymer nozzle members are highly resistant to corrosion by water-based printing inks and are generally hydrophobic. Further, laser-ablated polymer nozzle members are relatively compliant and, therefore, resist delamination. Still further, laser-ablated polymer nozzle members can be readily fixed to, or formed with, a polymer substrate.

Although an Excimer laser is used in the preferred embodiments, other ultraviolet light sources with substantially the same optical wavelength and energy density may be used to accomplish the ablation process. Preferably, the wavelength of such an ultraviolet light source will lie in the 150 nm to 400 nm range to allow high absorption in the tape to be ablated. Furthermore, the energy density should be greater than about 100 millijoules per square centimeter with a pulse length shorter than about 1 microsecond to achieve rapid ejection of ablated material with essentially no heating of the surrounding remaining material.

As will be understood by those of ordinary skill in the art, numerous other processes for forming a pattern on the tape 104 may also be used. Other such processes include chemical etching, stamping, reactive ion etching, ion beam milling, and molding or casting on a photodefined pattern.

A next step in the process is a cleaning step wherein the laser ablated portion of the tape 104 is positioned under a cleaning station 117. At the cleaning station 117, debris from the laser ablation is removed according to standard industry practice.

The tape 104 is then stepped to the next station, which is an optical alignment station 118 incorporated in a conventional automatic TAB bonder, such as an inner lead bonder commercially available from Shinkawa Corporation, model number IL-20. The bonder is preprogrammed with an alignment (target) pattern on the nozzle member, created in the same manner and/or step as used to created the orifices, and a target pattern on the substrate, created in the same manner and/or step used to create the resistors. In the preferred embodiment, the nozzle member material is semi-transparent so that the target pattern on the substrate may be viewed through the nozzle member. The bonder then automatically positions the silicon dies 120 with respect to the nozzle members so as to align the two target patterns. Such an alignment feature exists in the Shinkawa TAB bonder. This automatic alignment of the nozzle member target pattern with the substrate target pattern not only precisely aligns the orifices with the resistors but also inherently aligns the electrodes on the dies 120 with the ends of the conductive traces formed in the tape 104, since the traces and the orifices are aligned in the tape 104, and the substrate electrodes and the heating resistors are aligned on the substrate. Therefore, all patterns on the tape 104 and on the silicon dies 120 will be aligned with respect to one another once the two target patterns are aligned.

Thus, the alignment of the silicon dies 120 with respect to the tape 104 is performed automatically using only commercially available equipment. By integrating the conductive traces with the nozzle member, such an alignment feature is possible. Such integration not only reduces the assembly cost of the printhead but reduces the printhead material cost as well.

The automatic TAB bonder then uses a gang bonding method to press the ends of the conductive traces down onto the associated substrate electrodes through the windows formed in the tape 104. The bonder then applies heat, such as by using thermocompression bonding, to weld the ends of the traces to the associated electrodes. Other types of bonding can also be used, such as ultrasonic bonding, conductive epoxy, solder paste, or other well-known means.

The tape 104 is then stepped to a heat and pressure station 122. After the above-described bonding step, the silicon dies 120 are then pressed down against the tape 104, and heat is applied to cure an adhesive layer on the top surface of the dies 120 and physically bond the dies 120 to the tape 104.

Thereafter the tape 104 steps and is optionally taken up on the take-up reel 124. The tape 104 may then later be cut to form nozzle members of any length, such as a page-width length.

The resulting nozzle member is then positioned on a print cartridge 10, and the previously described adhesive seal of FIG. 6 is formed to firmly secure the nozzle member to the print cartridge, provide an ink-proof seal around the substrate between the nozzle member and the ink reservoir, and encapsulate the traces in the vicinity of the substrate so as to isolate the traces from the ink.

The foregoing has described the principles, preferred embodiments, and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An inkjet printhead comprising:

a strip of material having a plurality of nozzle sections and a plurality of conductor sections, each of said conductor sections extending beyond an associated one of said nozzle sections, a front surface of said strip for facing a recording medium for printing thereon, each of said nozzle sections containing a group of orifices formed in said strip of material, each of said conductor sections including a plurality of conductors affixed to a surface of said strip of material and having first ends leading to an associated one of said nozzle sections for conducting electrical signals, said conductors having second ends terminating at a location remote from an associated one of said nozzle sections for connection to an ink printer;

a plurality of substrates affixed to a back surface of said strip, each of said substrates opposing one said group of orifices, each of said substrates containing individually energizable ink injection elements for causing an amount of ink to be ejected from an associated one of said orifices, said first ends of said conductors being connected to electrodes on said substrates; and a fluid channel leading to each of said orifices and interposed between said substrates and said orifices, said fluid channel communicating with an ink reservoir, said fluid channel for allowing ink to flow proximate to said orifices, wherein said plurality of nozzle sections extends substantially across an entire width of a recording medium to be printed upon such that printing may be performed substantially across said entire width of said recording medium while said strip is fixed in position and said recording medium is moved with respect to said strip.

2. The inkjet printhead of claim 1 wherein said groups of orifices are formed using a step-and-repeat laser ablation process, where a first portion of said strip of material is subjected to masked laser radiation to form one or more groups of orifices then stepped so that a second portion of said strip is subjected to said masked laser radiation.

3. The inkjet printhead of claim 1 wherein each of said substrates contains a decoding circuit for decoding incoming signals and energizing one or more selected ink ejection elements, each of said substrates having a larger number of individual ink ejection elements than interconnections to an external power source.

4. The inkjet printhead of claim 1 wherein each of said substrates contains a demultiplexing circuit for demultiplexing incoming signals and energizing one or more selected ink ejection elements, each of said substrates having a larger number of individual ink ejection elements than interconnections to an external power source.

5. The inkjet printhead of claim 1 wherein said material is a flexible polymer strip.

6. The inkjet printhead of claim 1 wherein said fluid channel is formed within said strip of material.

7. The inkjet printhead of claim 1 wherein said plurality of orifices extends along a length of between approximately one-sixth and twelve inches.

8. The inkjet printhead of claim 1 wherein said orifices are formed in said strip of material using a laser.

9. The inkjet printhead of claim 1 wherein said plurality of substrates are aligned with respect to said orifices by aligning said substrates with alignment targets formed on said strip of material, said alignment targets formed in a same manner as used to form said orifices.

10. The inkjet printhead of claim 1 wherein each of said ink ejection elements comprises a heater resistor capable of vaporizing a quantity of said ink proximate to an orifice and expelling said ink from said orifice.

11. An inkjet printing device comprising:

a printhead having repeated orifice array patterns formed in a length of polymer film using a step-and-repeat laser ablation process, orifices within said array patterns for expelling ink, said polymer film having a plurality of conductive traces formed on a surface of said polymer film, said traces for conducting electrical signals to selectively energize ink ejection elements to cause a quantity of said ink to be expelled from an associated one of said orifices, said conductive traces having first ends terminating proximate to said orifice array patterns and having second ends terminating at a location remote from said orifice array patterns for connection to an ink printer, wherein said repeated orifice array patterns extend substantially across an entire width of a recording medium to be printed upon such that printing may be performed substantially across said entire width of said recording medium while said polymer film is fixed in position and said recording medium is moved with respect to said polymer film.

12. A method of forming an inkjet printhead, comprising the steps of:

forming a plurality of groups of orifices in a strip of material;

forming a plurality of conductive traces on said strip of material having first ends terminating proximate to said groups of orifices and having second ends terminating at a location remote from said groups of orifices for connection to an ink printer;

forming a fluid channel leading to each of said orifices, said fluid channel for communicating with an ink reservoir, said fluid channel allowing ink to flow proximate to said orifices;

affixing a plurality of substrates to said strip, each of said substrates opposing one group of orifices within said plurality of groups, each of said substrates containing ink ejection elements, each of said ink ejection elements being associated with one of said orifices for causing an amount of said ink to be ejected from an associated one of said orifices, said fluid channel being formed so as to be located between said substrates and said orifices; and connecting said first ends of said conductors to respective electrodes on said substrates.

13. The method of claim 12 wherein said material is a flexible polymer strip.

14. The method of claim 12 wherein said fluid channel is formed within said strip of material.

15. The method of claim 12 wherein said plurality of groups of orifices are formed in an array extending substantially across an entire width of a recording medium to be printed upon such that printing may be performed substantially across said entire width of said recording medium while said strip is fixed in position and said recording medium is moved with respect to said strip.

16. The method of claim 12 wherein said orifices are formed using a step-and-repeat laser ablation process, wherein a masking means defines a pattern of orifices on said strip and said strip is subjected to masked laser radiation.

17. The method of claim 16 wherein said fluid channel is also formed using said step-and-repeat laser ablation process.

18. The method of claim 12 further comprising the step of aligning said substrates, prior to said step of affixing, with respect to said orifices by aligning said substrates with alignment targets formed on said strip of material, said alignment targets formed in a same manner as used to form said orifices.

19. The method of claim 12 wherein each of said ink ejection elements comprises a heater resistor capable of vaporizing a quantity of said ink proximate to an orifice and expelling said ink from said orifice.

20. An inkjet printhead comprising:

a strip of material having a plurality of groups of orifices formed therein, a front surface of said strip for facing a recording medium for printing thereon;

a plurality of substrates affixed to a back surface of said strip, each of said substrates opposing one group of orifices within said plurality of groups, each of said substrates containing individually energizable ink injection elements for causing an amount of ink to be ejected from an associated one of said orifices; and a fluid channel leading to each of said orifices and interposed between said substrates and said orifices, said fluid channel communicating with an ink reservoir, said fluid channel for allowing ink to flow proximate to said orifices, wherein said fluid channel is formed within said strip of material.

21. A method of forming an inkjet printhead, comprising the step of:

forming a plurality of groups of orifices in a strip of material;

forming a fluid channel leading to each of said orifices, said fluid channel for communicating with an ink reservoir, said fluid channel allowing ink to flow proximate to said orifices; and affixing a plurality of substrates to said strip, each of said substrates opposing one group of orifices within said plurality of groups, each of said substrates containing ink ejection elements, each of said ink ejection elements being associated with one of said orifices for causing an amount of said ink to be ejected from an associated one of said orifices, said fluid channel being formed so as to be located between said substrates and said orifices, wherein said fluid channel is formed within said strip of material.

22. A method of forming an inkjet printhead, comprising the steps of:

forming a plurality of groups of orifices in a strip of material;

forming a fluid channel leading to each of said orifices, said fluid channel for communicating with an ink reservoir, said fluid channel allowing ink to flow proximate to said orifices; and affixing a plurality of substrates to said strip, each of said substrates opposing one group of orifices within said plurality of groups, each of said substrates containing ink ejection elements, each of said ink ejection elements being associated with one of said orifices for causing an amount of said ink to be ejected from an associated one of said orifices, said fluid channel being formed so as to be located between said substrates and said orifices, wherein said orifices are formed using a step-and-repeat laser ablation process, wherein a masking means defines a pattern of orifices on said strip and said strip is subjected to masked laser radiation, and wherein said fluid channel is also formed in said strip using said step-and-repeat laser ablation process.

* * * * *